US007336916B2

(12) United States Patent
Jung et al.

(10) Patent No.: US 7,336,916 B2
(45) Date of Patent: Feb. 26, 2008

(54) ELECTROPHOTOGRAPHIC IMAGE FORMING APPARATUS

(75) Inventors: Woo-chul Jung, Yongin-si (KR); Heung-sup Jeong, Suwon-si (KR); Se-hyun Lyu, Seoul (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 116 days.

(21) Appl. No.: 11/138,291

(22) Filed: May 27, 2005

(65) Prior Publication Data

US 2005/0265746 A1 Dec. 1, 2005

(30) Foreign Application Priority Data

May 29, 2004 (KR) ..... 10-2004-0038745

(51) Int. Cl.
*G03G 21/16* (2006.01)

(52) U.S. Cl. ..... 399/111; 399/110; 399/117; 399/116

(58) Field of Classification Search ..... 399/111, 399/112, 114, 117, 390, 384
See application file for complete search history.

(56) References Cited

U.S. PATENT DOCUMENTS

| | | | | |
|---|---|---|---|---|
| 7,076,187 | B2 * | 7/2006 | Jeong et al. | 399/110 |
| 7,092,657 | B2 * | 8/2006 | Nakashima et al. | 399/111 |
| 2003/0161654 | A1 * | 8/2003 | Yokomori et al. | 399/111 |
| 2005/0047821 | A1 * | 3/2005 | Murayama et al. | 399/111 |
| 2006/0127129 | A1 * | 6/2006 | Jung et al. | 399/111 |

FOREIGN PATENT DOCUMENTS

| | | |
|---|---|---|
| JP | 11-223974 | 8/1999 |
| KR | U1996-0038344 | 12/1996 |
| KR | P1998-051632 | 9/1998 |
| KR | U2000-0004726 | 3/2000 |

* cited by examiner

*Primary Examiner*—David M. Gray
*Assistant Examiner*—David A Blackshire
(74) *Attorney, Agent, or Firm*—Roylance, Abrams, Berdo & Goodman, L.L.P.

(57) ABSTRACT

An electrophotographic image forming apparatus includes a print unit that prints an image by an electrophotographic process and has a developer cartridge having a photoreceptor drum. A door opens and closes one side of the print unit to install and remove the developer cartridge. A fixing member is selectively shifted between a first position where the developer cartridge is installed and removed and a second position where the developer cartridge is fixed to the print unit by opening and closing the door.

17 Claims, 5 Drawing Sheets

ELECTROPHOTOGRAPHIC IMAGE FORMING APPARATUS

CROSS REFERENCE TO RELATED APPLICATIONS

This application claims the benefit under 35 U.S.C. § 119(a) of Korean Patent Application No. 2004-38745, filed on May 29, 2004, in the Korean Intellectual Property Office, the entire disclosure of which is hereby incorporated by reference.

BACKGROUND OF THE INVENTION

1. Field of the Invention

The present invention relates to an image forming apparatus. More particularly, the present invention relates to an electrophotographic image forming apparatus having a detachable developer cartridge.

2. Description of the Related Art

An electrophotographic image forming apparatus produces an image by forming an electrostatic latent image corresponding to a desired image by scanning light onto a photosensitive medium charged to a uniform electrostatic potential. The latent image is developed by providing toner thereto. The image developed on the photosensitive medium is transferred directly to a sheet of print paper or indirectly through an intermediate transfer. The transferred image is fused by applying heat and pressure thereto.

The electrophotographic image forming apparatus includes a developer cartridge containing a photosensitive medium and toner. The developer cartridge is replaced when the service life of the cartridge ends, and thus installed to be detachable from the main body of the image forming apparatus. Once the developer cartridge is installed, the cartridge has to be fixed tightly at a predetermined position.

An HP printer (such as, for example, HP 3500) employs a coupler to be driven by a drive motor to fix a developer cartridge to a main body. When the developer cartridge has been separated, the coupler is moved back to avoid interfering with the installed developer cartridge. After the developer cartridge is installed and a door is closed, the drive motor is rotated. The coupler is advanced and coupled with one end of a photoreceptor drum, and accordingly the replaced developer cartridge is fixed at a predetermined position. When the door is opened to detach the developer cartridge, the drive motor is rotated in an opposite direction and the coupler is moved back and separated from one end of the photoreceptor drum.

In the above described method of fixing a developer cartridge using a drive motor, when the supply of electricity is interrupted, for example, when a power supply unit of a main body of the image forming apparatus malfunctions, the coupler cannot be moved back, thereby disabling detaching the developer cartridge from the apparatus.

Further, in such a HP printer, the coupler and one end of the photoreceptor drum have complementary shapes. Thus, if the developer cartridge is not installed at a proper position, the coupler and one end of the photoreceptor drum cannot be coupled together, thereby causing developer cartridge installation failure.

SUMMARY OF THE INVENTION

The present invention provides an improved electrophotographic image forming apparatus in which a developer cartridge may be fixed and detached independently of a drive motor.

According to an aspect of the present invention, an electrophotographic image forming apparatus includes a print unit that prints an image. A door opens and closes one side of the print unit to install and detach a developer cartridge. A fixing member may be selectively shifted between a first position where the developer cartridge is allowed to be installed and detached and a second position where the developer cartridge is fixed to the print unit by opening and closing the door.

According to another aspect of the present invention, an electrophotographic image forming apparatus includes a print unit having a developer cartridge having a photoreceptor drum. A door pivots between open and closed positions on one side of the print unit to install and detach the developer cartridge. One end portion of the photoreceptor drum is inserted in an inserting portion when the developer cartridge is installed. A sliding member has first and second interfering portions and slides as the door pivots. A fixing member may be shifted between a first position where the developer cartridge is allowed to be installed and detached by the interference of the first interfering portion when the door is opened and a second position where the developer cartridge is fixed because a portion of the fixing member that faces the inserting portion contacts one end portion of the photoreceptor drum and interferes with the second interfering portion when the door is closed.

Other objects, advantages and salient features of the invention will become apparent from the following detailed description, which taken in conjunction with the annexed drawings, discloses preferred embodiments of the invention.

BRIEF DESCRIPTION OF THE DRAWINGS

The above and other features and advantages of the present invention will become more apparent by describing in detail exemplary embodiments thereof with reference to the attached drawings in which.

Throughout the drawings, like reference numerals will be understood to refer to like parts, components and structures.

DETAILED DESCRIPTION OF EXEMPLARY EMBODIMENTS

Figure 1:
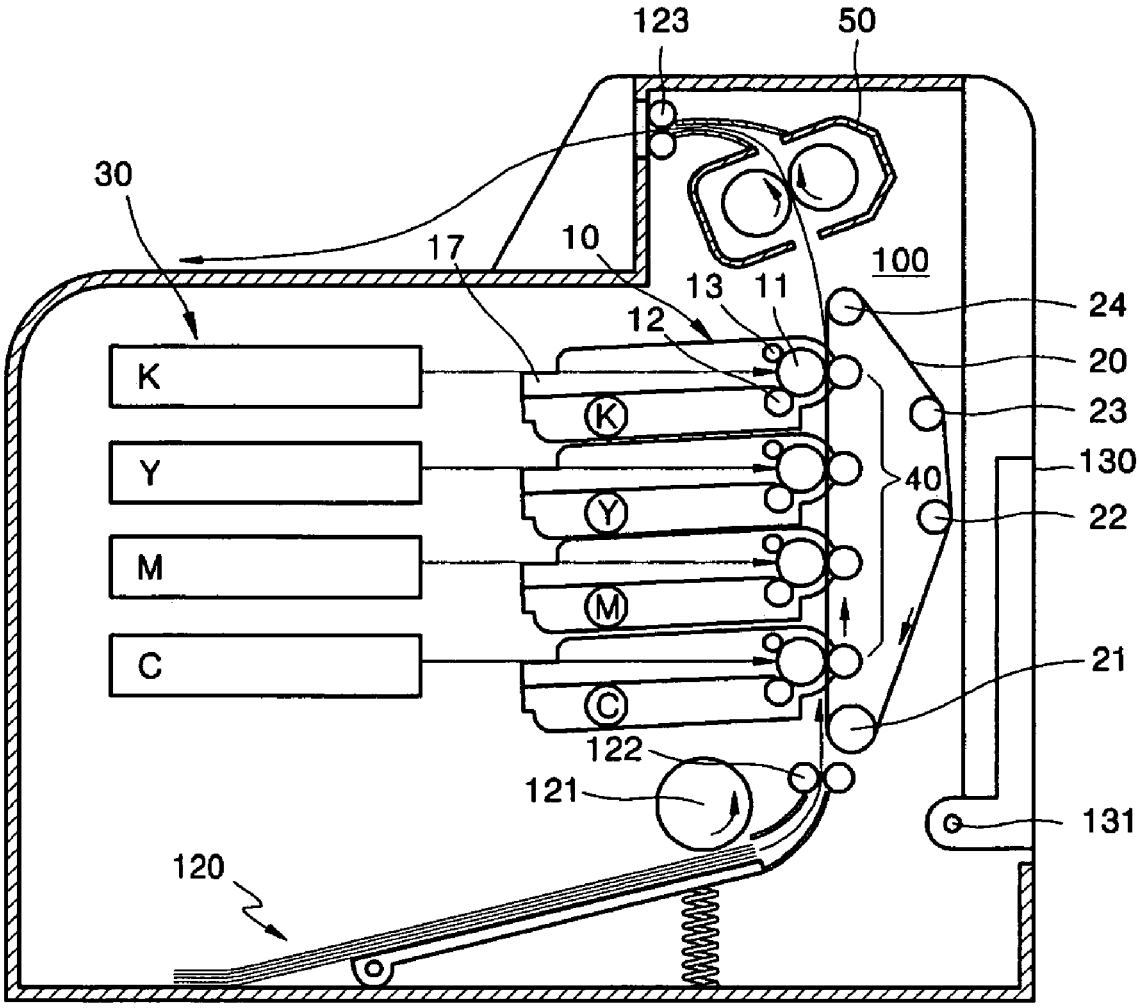
FIG. 1 is a configuration diagram of an electrophotographic image forming apparatus according to an embodiment of the present invention.

FIG. 1 is a simple configuration diagram of an electrophotographic image forming apparatus according to an exemplary embodiment of the present invention. In this exemplary embodiment, the image forming apparatus is a color image forming apparatus.

Referring to FIG. 1, the image forming apparatus includes a print unit 100 that prints an image onto a sheet of print paper by an electrophotographic process, a cassette 120 that contains sheets of print paper, a pick-up roller 121 that draws out a sheet of print paper from the cassette 120, and feed rollers 122 that feed a sheet of print paper.

The print unit 100 includes four developer cartridges 10C, 10M, 10Y and 10K that contain ink of different colors, for example, cyan (C), magenta (M), yellow (Y) and black (K)

colors individually. The print unit also has a conveying belt 20, scanning units 30C, 30M, 30Y and 30K, transfer rollers 40 and a fuser 50.

The conveying belt 20 circulates while being supported by a plurality of support rollers 21, 22, 23 and 24. The conveying belt 20 is preferably installed in a vertical direction. According to an embodiment, each scanning unit 30C, 30M, 30Y and 30K scans light corresponding to image data of cyan (C), magenta (M), yellow (Y) and black (K) colors onto each photoreceptor drum 11 of developer cartridges 10C, 10M, 10Y and 10K. In this embodiment, the scanning units 30C, 30M, 30Y and 30K may use laser diodes as light sources.

Each of the developer cartridges 10C, 10M, 10Y and 10K includes a photoreceptor drum 11 and a developing roller 12. Each developer cartridge 10C, 10M, 10Y and 10K according to the embodiment further includes an electrostatic charging roller 13. A charging bias voltage is applied to the electrostatic charging roller 13 so that the outer circumference of the photoreceptor drum 11 is charged to a uniform electrostatic potential. Instead of the electrostatic charging roller 13, a corona discharger (not illustrated) may be used. The developing roller 12 provides toner to the photoreceptor drum 11 by adhering the toner on an outer circumference thereof. A developing bias is applied to the developing roller 12 to supply the toner to the photoreceptor drum 11. Although not illustrated in the drawings, each of the developer cartridges 10C, 10M, 10Y and 10K may further include a supply roller that adheres the toner to the developing roller 12, a regulating unit that regulates the quantity of toner adhered to the developing roller 12, and an agitator that transfers toner contained therein to the supply roller and/or the developing roller 12. Each of the developer cartridges 10C, 10M, 10Y and 10K includes an opening 17 that forms a passage for light from the scanning unit 30C, 30M, 30Y or 30K to scan the photoreceptor drum 11. The outer circumference surfaces of the photoreceptor drums 11 face the conveying belt 20.

The four transfer rollers 40 are arranged such that the conveying belt 20 is positioned between the photoreceptor drums 11 of the developer cartridges 10C, 10M, 10Y and 10K and the four transfer rollers 40. Transfer bias is applied to the transfer rollers 40.

The process of forming a color image with the above structure is described hereafter.

The photoreceptor drum 11 of each developer cartridge 10C, 10M, 10Y and 10K is charged to a uniform electrostatic potential by applying a charging bias voltage to the electrostatic charging roller 13. The four scanning units 30C, 30M, 30Y and 30K form an electrostatic latent image by radiating light corresponding to image data of respective cyan, magenta, yellow and black colors onto the photoreceptor drum 11 of each developer cartridge 10C, 10M, 10Y and 10K through the openings 17 therein. A developing bias voltage is applied to the developing roller 12. Then, toner adhered to the outer circumference of the developing roller 12 adheres to the electrostatic latent image, and consequently toner images of respective cyan, magenta, yellow and black colors are formed on the photoreceptor drum 11 of each developer cartridge 10C, 10M, 10Y and 10K.

A sheet of print paper is picked out from the cassette 120 by the pick-up roller 121. The sheet of print paper is transferred to the conveying belt 20 by the feed rollers 122. The sheet of print paper may be adhered to the surface of the conveying belt 20 by static electricity and fed at the same speed as the conveying belt 20 travels.

For example, a front end of paper reaches the transfer nip about the time when a front end of a cyan (C) toner image formed on the outer surface of the photoreceptor drum 11 of the developer cartridge 10C arrives at the transfer nip of the transfer roller 40. When a transfer bias voltage is applied to the transfer rollers 40, the toner images formed on the photoreceptor drums 11 are transferred to the sheet of print paper. As the sheet of print paper is fed, the magenta (M), yellow (Y) and black (K) toner images formed on the photoreceptor drum 11 of the developer cartridges 10M, 10Y and 10K are sequentially transferred to the sheet of print paper in an overlapping manner, and thus a color toner image is formed on the sheet of print paper. The fuser 50 fixes the color toner image formed on the sheet of print paper by applying heat and pressure. The sheet of print paper to which the toner image has been fixed is discharged outside the image forming apparatus by discharging rollers 123.

The developer cartridges 10 are expendable supplies that have to be exchanged when their life span ends. Therefore, the developing cartridges 10 in an exemplary embodiment are installed to be detachable from the print unit 100. Further, the image forming apparatus includes a door 130 for opening and closing one side of the print unit 100 to install or detach the developer cartridges 10 according to the embodiment.

Figure 2:
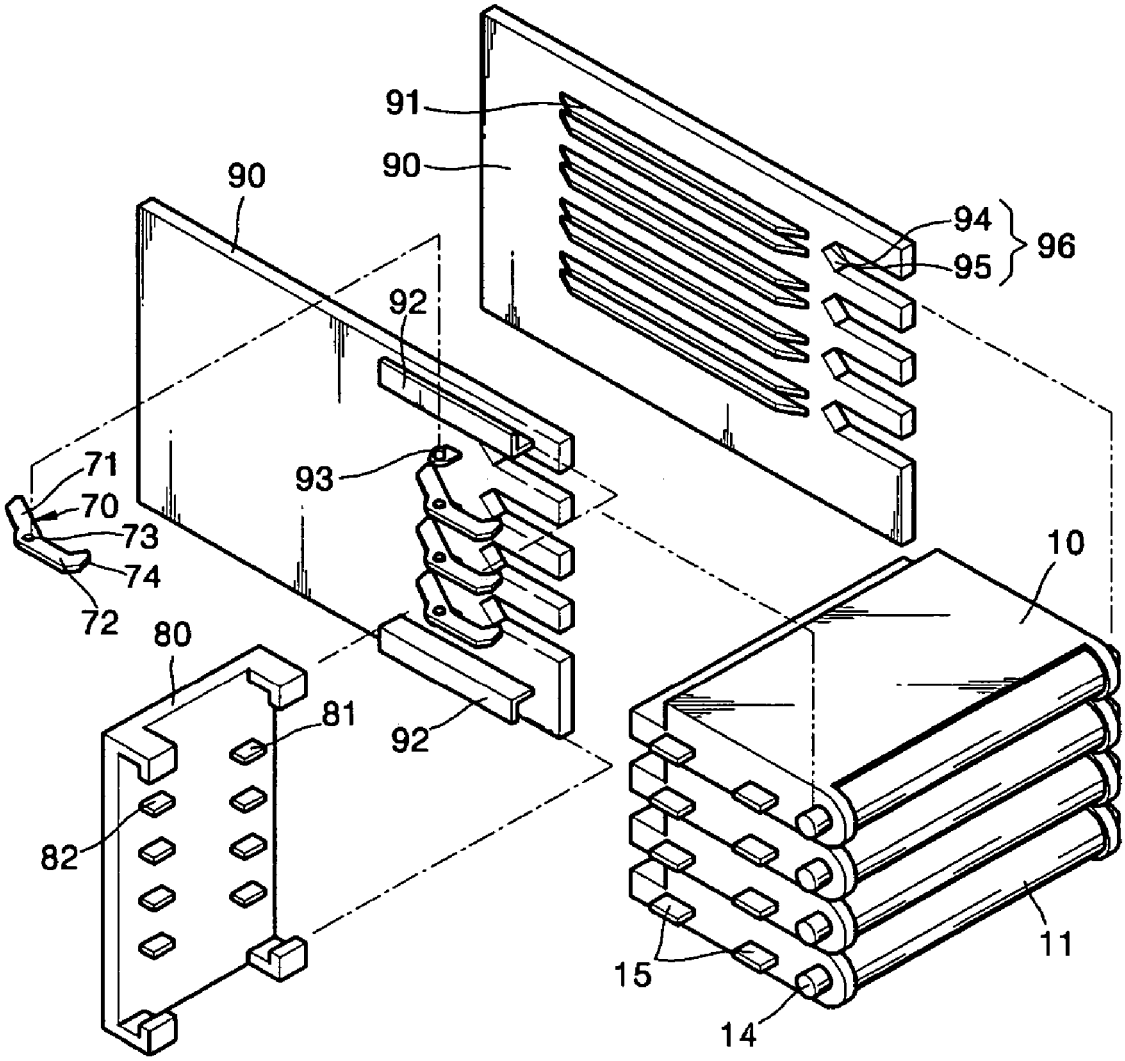
FIGS. 2 and 3 are an exploded perspective view and a side elevational view of a frame and fixing member adapted to receive a developer cartridge according to an embodiment of the present invention.
Figure 3:
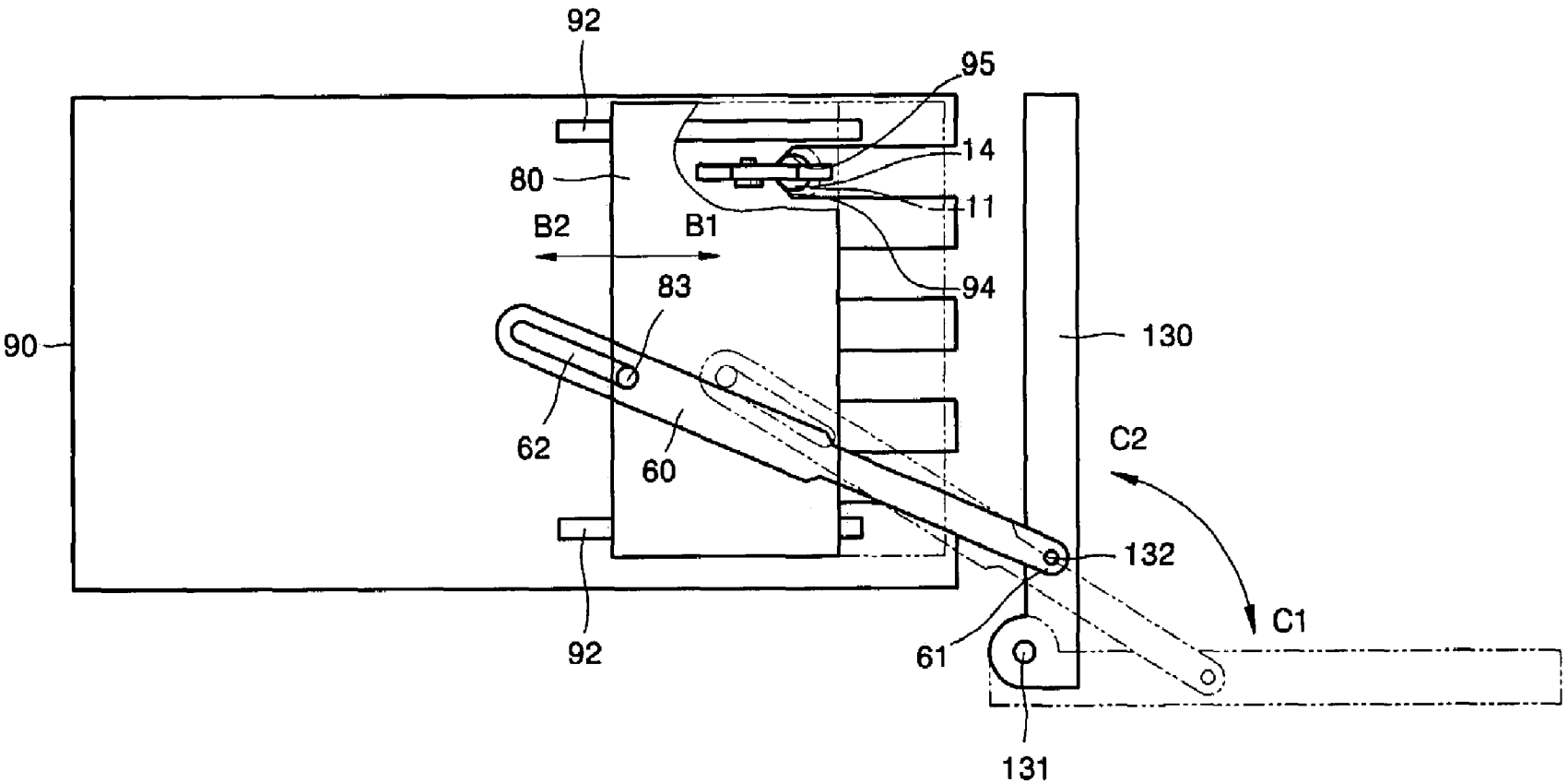

FIGS. 2 and 3 are an exploded perspective view and a side elevational view of a structure for detaching a developer cartridge 10 according to an exemplary embodiment of the present invention. In FIG. 2, a pair of frames 90 with respective guide rails 91 are illustrated. Protrusions 15 on both sides of the developer cartridge 10 are adapted to be received by the guide rails 91. The developer cartridge 10 is installed and detached by sliding the developer cartridge along the guide rails 91 in a horizontal direction. End portions 14 of the photoreceptor drum 11 protrude toward sides of the developer cartridge 10. The frame 90 includes inserting portions 96 into which the end portions 14 of the photoreceptor drum 11 are inserted when the developer cartridge 10 is installed. Since the end portions 14 of the photoreceptor drum 11 commonly have circular shapes, preferably the inserting portions 96 are substantially V-shaped, as shown in FIG. 2. Accordingly, two sides 94 and 95 of the inserting portions 96 support the end portions 14 of the photoreceptor drum 11.

Fixing members 70 are joined to the frame 90. Each of the fixing members 70 may be in a first position where the developer cartridge 10 is allowed to be detached or a second position where the developer cartridge 10 is fixed or secured to the print unit 100. The fixing members 70 according to an embodiment may be switched to either the first position or the second position by opening or closing the door 130.

According to an exemplary embodiment, the door 130 opens and closes one side of the print unit 100 by pivoting, as shown in FIG. 3. Here, the conveying belt 20 and the transfer rollers 40 rotate together. The fixing member 70, according to an exemplary embodiment, pivots between the first and second positions about the pivot axis 93. An opening 73 in the fixing member 70 receives the pivot axis 93. The fixing member 70 has first and second arms 71 and 72 extending from the opening 73. A hook 74 is provided on an end of the second arm 72.

The image forming apparatus according to an exemplary embodiment includes a sliding member 80 that slides along the rail 92 formed on the frame 90, as illustrated in FIGS. 2 and 3. The door 130 is connected to the sliding member 80 by a lever 60. A shaft 132 is installed in the door 130 offset from the pivot center 131. One end 61 of the lever 60 pivots about the shaft 132. A slot 62 is formed in the lever 60. A boss 83 formed on the sliding member 80 is received in the slot portion 62 of the lever 60. Accordingly, the sliding member 80 slides backwards and forwards as the door 80 is turned. The sliding member 80 includes first and second interfering portions 81 and 82 for pivoting the fixing member 70. The first interfering portion 81 pivots the fixing member 70 to the first position by pushing the first arm 71 when the door 130 is opened. The second interfering portion 82 pivots the fixing member 70 to the second position by pushing the second arm 72 when the door 130 is closed.

Figure 4:
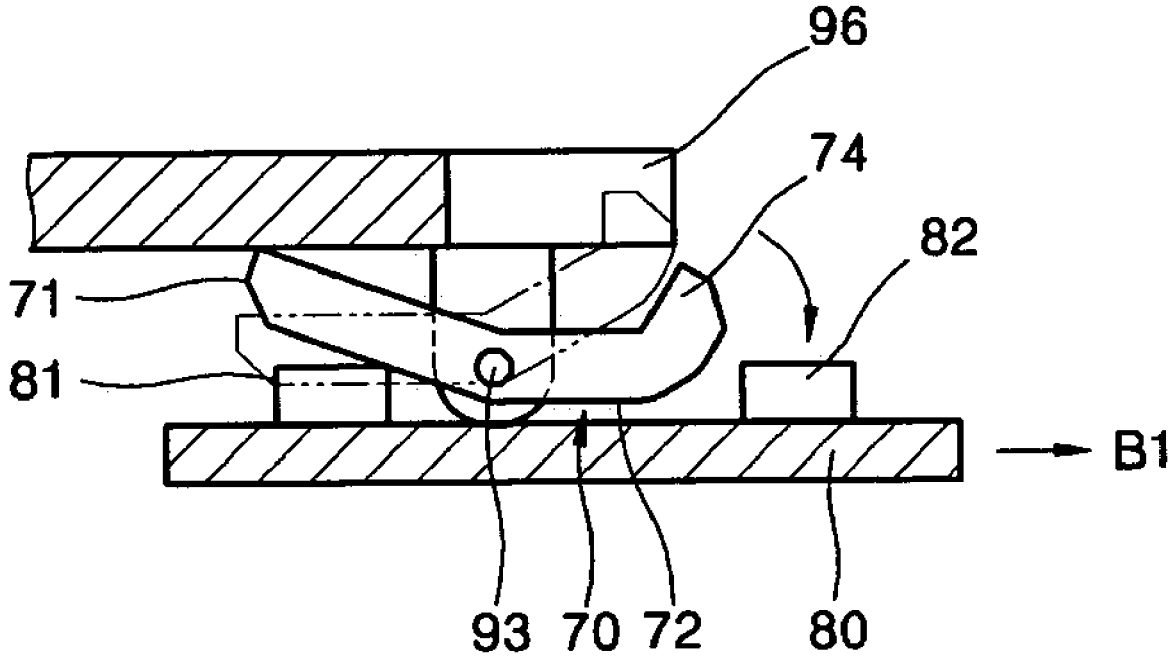
FIGS. 4-6 are top plan views of fixing member positions during installation and removal of a developer cartridge.
Figure 5:
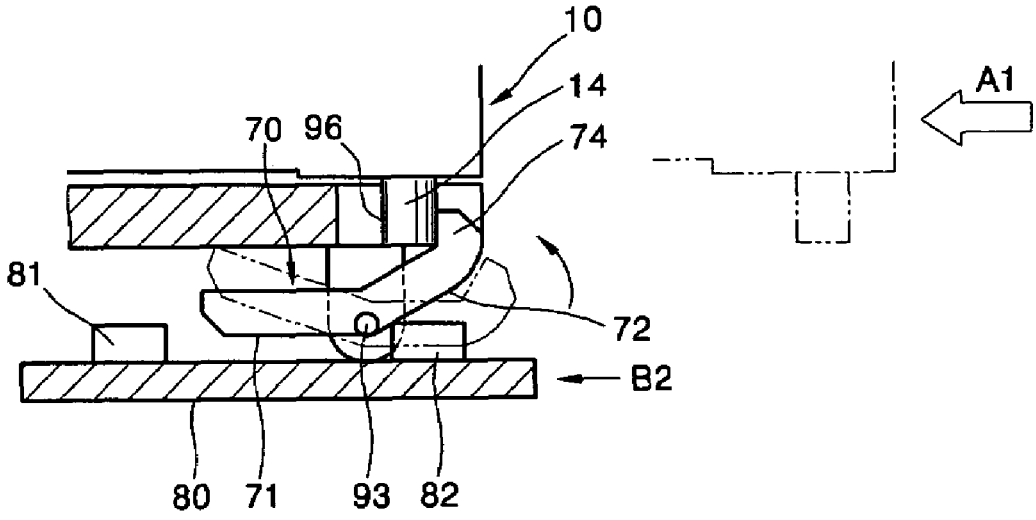
Figure 6:
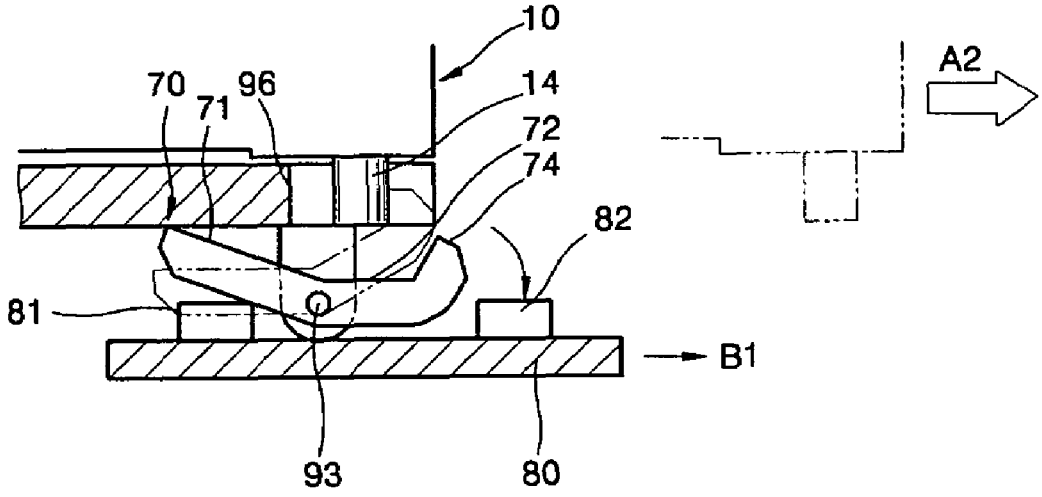

FIGS. 4 through 6 are top plan views illustrating the positions of the fixing member during installation and removal of the developer cartridge. The installation and removal operations of the developer cartridge 10 are described with reference to FIGS. 4 through 6.

First, the operation of installing the developer cartridge 10 in the print unit 100 is described. One side of the print unit 100 is opened by pivoting the door 130 in the direction indicated by arrow C1 of FIG. 3. Then, the sliding member 80 is drawn by the lever 60 to slide in the direction indicated by arrow B1 in FIG. 4. The first interfering portion 81 pivots the fixing member 70 to the first position where the developer cartridge 10 is allowed to be installed and detached by pushing the first arm 71. When the developer cartridge 10 is inserted along the guide rail 91 in the direction indicated by arrow A1 of FIG. 5, the end portion 14 of the photoreceptor drum 11 is inserted in the inserting portion 96. The end portion 14 is supported by the first side 94 and the second side 95. The door 130 is closed by pivoting in the direction indicated by arrow C2 of FIG. 3. Then, the lever 60 pushes the sliding member 80 to slide in the direction indicated by arrow B2 of FIG. 5. Here, the second interfering portion 82 pushes the second arm 72 such that the fixing member 70 pivots to the second position, as illustrated in FIG. 5. A portion of the hook 74 of the fixing member 70 that faces the inserting portion 96 contacts the end portion 14 of the photoreceptor drum 11 such that the developer cartridge 10 is removable from the inserting portion 96.

The developer cartridge 10 is fixed while being supported at three points by the inserting portion 96 and the hook 74 of the fixing member 70. Therefore, even if the developer cartridge is not fully inserted in the inserting portion 96, the fixing member 70 pivots and pushes the end portion 14 of the photoreceptor drum 11 to be completely inserted in the insertion portion 96, and thus the developer cartridge 10 rarely fails to be inserted. Further, since the second interfering portion 82 remains engaged with the second arm 72, the fixing member 70 cannot pivot and is locked in the second position unless the door 130 is opened. Accordingly, the developer cartridge 10 is firmly installed in the print unit 100.

Next, the processes of detaching the developer cartridge 10 from the print unit 100 are described. The door 130 is pivoted in the direction indicated by arrow C1 of FIG. 3 to open one side of the print unit 100. Then, the sliding member 80 is drawn by the lever 60 to slide in the direction indicated by arrow B1 of FIG. 6. As illustrated in FIG. 6, the first interfering portion 81 pushes the first arm 71 of the fixing member 70 to pivot the fixing member 70 to the first position where the developer cartridge 10 is removable. Because the hook 74 is separated from the end portion 14 of the photoreceptor drum 11, a user may pull the developer cartridge 10 in the direction indicated by arrow A2 of FIG. 6 to remove the cartridge from the print unit 100.

As described above, in the image forming apparatus according to exemplary embodiments of the present invention, the developer cartridge 10 is installed in or removed from the print unit 100 by the fixing member 70, which moves in synchronization with the opening and closing of the door 130. Therefore, regardless of receiving power supply, the developer cartridge 10 may be installed in or detached from the print unit 100. Further, since the structure of the image forming apparatus according to the present invention is simpler than that of a conventional image forming apparatus using a drive motor, the costs for parts and assembling the parts may be reduced.

Although the image forming apparatus having four developer cartridges 10 has been described in the above embodiments, the scope of the present invention is not limited to this number of developer cartridges. Further, although it has been described that the fixing member 70 pivots between the first and second positions, the scope of the present invention is not limited thereto.

As described above, according to the present invention, an electrophotographic image forming apparatus with a simple structure that allows developer cartridges to be installed in or removed from a print unit regardless of receiving power supply may be implemented.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. An electrophotographic image forming apparatus, comprising:

a print unit that prints an image;

a developer cartridge;

a door opening and closing one side of the print unit to install and remove the developer cartridge; and a fixing member movable between a first position and a second position by a sliding member moved by the opening and closing of the door, the sliding member having first and second interfering portions, wherein when the fixing member is in the first position the developer cartridge is installable and removable and when the fixing member is in the second position the developer cartridge is fixed to the print unit.

2. The electrophotographic image forming apparatus of claim 1, wherein the door is pivotable.

3. The electrophotographic image forming apparatus of claim 1, wherein the sliding member having first and second interfering portions is connected to the door to slide backwards and forwards by the opening and closing movement of the door, the fixing member is moved between the first and second positions by the interference of the first and second interfering portions when the door is opened and closed.

4. The electrophotographic image forming apparatus of claim 3, wherein the first and second interfering portions lock the fixing member in the first position and the second position, respectively.

5. The electrophotographic image forming apparatus of claim 3, wherein an end portion of the photoreceptor drum is inserted in an inserting portion when the developer cartridge is installed, a portion of the fixing member faces the inserting portion and contacts the end portion of the photoreceptor drum when the fixing member is in the second position to fix the developer cartridge.

6. The electrophotographic image forming apparatus of claim 3, wherein the fixing member pivots between the first position and the second position.

7. An electrophotographic image forming apparatus, comprising:

a print unit having a developer cartridge with a photoreceptor drum;

a pivotable door to open and close one side of the print unit to install and remove the developer cartridge;

an inserting portion in which an end portion of the photoreceptor drum is inserted when the developer cartridge is installed;

a sliding member having first and second interfering portions and sliding as the door pivots; and a fixing member movable between a first position where the developer cartridge is installed and detached by the interference of the first interfering portion when the door is opened and a second position where the developer cartridge is fixed by a portion of the fixing member contacting the end portion of the photoreceptor drum and interfering with the second interfering portion when the door is closed.

8. The electrophotographic image forming apparatus of claim 7, wherein the first and second interfering portions lock the fixing member in the first position and the second position, respectively.

9. The electrophotographic image forming apparatus of claim 7, wherein a lever slides the sliding member backwards and forwards as the door pivots and has a first end connected to the door offselt from a pivot center of the door and a second end coupled to the sliding member.

10. The electrophotographic image forming apparatus of claim 7, wherein the fixing member pivots between the first and second positions.

11. An electrophotographic image forming apparatus, comprising:

a developer cartridge having a first end portion extending outwardly therefrom;

a frame member having a recess adapted to receive the first end portion of the developer cartridge;

a fixing member pivotally connected to the frame member; and a door connected to the fixing member, wherein when the door is closed the fixing member is in a second position that prevents the developer cartridge from being removed, and when the door is open the fixing member is in a first position in which the developer cartridge is insertable in or removable from the electrographic image forming apparatus;

wherein opening and closing of the door moves a sliding member such that the movement of the sliding member moves the fixing member between the first and second positions.

12. The electrophotographic image forming apparatus of claim 11, wherein a shaft connects the door to the sliding member.

13. The electrophotographic image forming apparatus of claim 12, wherein the shaft is connected to the door offset from a pivot point of the door.

14. The electrophotographic image forming apparatus of claim 11, wherein a hook on the fixing member contacts the first end portion of the developer cartridge when the fixing member is in the second position to prevent removal of the developer cartridge.

15. The electrophotographic image forming apparatus of claim 11, wherein the sliding member is connected to the frame member, the sliding member being connected to the door and engaging the fixing member to move the fixing member between the first and second positions in response to opening and closing of the door.

16. The electrophotographic image forming apparatus of claim 15, wherein first and second tabs extend inwardly from the sliding member, the first tab engaging the fixing member when the sliding member moves forwardly to move the fixing member to the first position, and the second tab engaging the fixing member when the sliding member moves rearwardly to move the fixing member to the second position.

17. The electrophotographic image forming apparatus of claim 15, wherein the sliding member has a protrusion extending outwardly therefrom, a shaft connects the sliding member to the door, the shaft is connected to the door from a pivot point of the door, and the shaft has a slot adapted to receive the protrusion.

* * * * *